United States Patent [19]

Kostylev et al.

[11] Patent Number: 4,709,768

[45] Date of Patent: Dec. 1, 1987

[54] ANNULAR AIR HAMMER APPARATUS FOR DRILLING WELLS

[75] Inventors: Alexandr D. Kostylev; Vladimir P. Boginsky; Boris N. Smolyanitsky; Jury N. Syryamin; Boris B. Danilov, all of Novosibirsk; David I. Kogan; Vyacheslav N. Saveliev, both of Moscow, all of U.S.S.R.

[73] Assignee: Institut Gornogo Dela So An USSR, Novosibirsk, U.S.S.R.

[21] Appl. No.: 902,671

[22] Filed: Sep. 2, 1986

[51] Int. Cl.[4] ..... E21B 4/14

[52] U.S. Cl. ..... 175/296; 175/417

[58] Field of Search ..... 175/293, 296, 297, 415, 175/417, 418; 173/71, 76, 78, 80

[56] References Cited

U.S. PATENT DOCUMENTS 3,299,971 1/1967 Lewis ..... 175/296
4,509,606 4/1985 Willis ..... 175/69

FOREIGN PATENT DOCUMENTS 2854461 6/1980 Fed. Rep. of Germany .
0470608 7/1975 U.S.S.R. ..... 173/78
1133388 1/1985 U.S.S.R. .

*Primary Examiner*—Stephen J. Novosad
*Assistant Examiner*—Terry Lee Melius
*Attorney, Agent, or Firm*—Fleit, Jacobson, Cohn & Price

[57] ABSTRACT

An annular air hammer apparatus for drilling wells has a cylindrical body which accommodates a stepped annular hammer mounted for reciprocations. A stepped air distribution tube is rigidly secured in the body and has inlet ports and exhaust ports, the tube cooperating with the hammer and defining therewith a work stroke chamber and defining a return stroke chamber with the body. A pipe for receiving drillings is stationary mounted in the air distribution tube and defines therewith a plenum. An annular member is provided between the pipe for receiving drillings and air distribution pipe, in the zone between the inlet and exhaust ports, to define an exhaust chamber between the pipe for receiving drillings and air distribution tube. The plenum and exhaust chamber permanently communicate with each other through a throttle means.

7 Claims, 12 Drawing Figures

ANNULAR AIR HAMMER APPARATUS FOR DRILLING WELLS

FIELD OF THE ART

The invention relates to the mining industry, construction and geological prospecting engineering, and in particular, it deals with air hammer apparatuses to be used for drilling wells for various applications using a double drill pipe string with the conveyance of well bottom cuttings (core and drillings) to the surface along the central axial passage of the string with the return flow of a gaseous or gaseous and liquid cleaning and energy carrier agent, and more specifically, the invention relates to annular air hammer apparatuses for drilling wells.

The invention may be most advantageously used for drilling wells for the exploration of alluvial mineral deposits in the areas of permafrost and in the continental shelves; in erecting pile foundations for building installations. The invention may also be effectively used in the mining industry for drilling wells in hard rocks in quarries.

BACKGROUND OF THE INVENTION

In carrying out the air hammer drilling of wells for various applications, the use is made of downhole air hammer apparatuses (air hammers) effecting rock breaking over the whole area of the well bottom, the cuttings (drillings) being removed to the surface with the exhaust air through the annulus between the well wall and the drill pipe string. The well head is provided with a dust trapping system which in the majority of applications proves inadequate and cannot ensure compliance with the sanitary rules governing dust lading at the drilling operator workplace.

The air hammers of the downhole type are of a very limited use in drilling geological exploration wells in alluvial mineral deposits in the permafrost areas because of thawing and collapse of well walls under the action of the exhaust air flow. Therefore, for the abovementioned reasons, the use of the downhole air hammers that do not have the internal return passages for drillings cannot bring a solution to the problem of obtaining a reliable information on the geological structure of a deposit (rock mass).

In order to improve reliability of the geological trial and to avoid thawing and collapse of well walls in drilling of permafrost rocks, the downhole air hammers are used in combination with a double drill pipe string, the well bottom cuttings being transported to the surface through the axial passage of the pipe string. However, in this case the arrangement of the bottom part of the drill string is much more complicated, and the return path for the exhaust cleaning agent enriched with drillings becomes rather intricate. The cleaning and energy carrier agent (compressed air) is first admitted from the intertube space of the double drill pipe string through passages of a distribution adapter to a centrally located air hammer. Then the cleaning agent washes and cleans the well bottom and enriched with drillings moves towards the well head between the well wall and the air hammer body to get into narrow return passages of the adapter and only after that it is directed into the inner pipe of the double pipe string. This return path of the air and drillings flow results in a high probability of the formation of drillings plugs in the passages of the adapter and glands in the well bottom zone and, in case of collapse of the well walls, circulation of the energy carrier can be interrupted and the drilling may stop.

These difficulties can be avoided to a large extent when a double drill pipe string is used with an annular air hammer having a central axial passage defining, together with the interior space of the string, a straight smooth-bore duct for drillings of a constant cross-section.

Known in the art is an annular air hammer apparatus (rock drill) (cf. FRG Pat. No. 2854461, Int. Cl. E 21 C 3/24, 1978), comprising an annular rock breaking tool and an annular hammer regularly delivering blows to the tool, the hammer being accommodated in a cylindrical chamber having air distribution ports. The apparatus also has a reverse valve and an inner pipe for receiving drillings.

Such apparatuses are used for core drilling of wells with simultaneous action of the percussive force and tool rotation. They are made in the form of downhole air-powered devices, the compressed air being supplied through the space between the inner pipe string and the outer pipe string to the reverse valve wherefrom it is admitted to the air hammer apparatus. The exhaust of the energy carrier from the air hammer apparatus is effected through a space between the outer pipe and the rock breaking tool.

The prior art annular air hammer apparatuses feature a complicated structure of their air distribution devices imposing stringent requirements upon parameters of the energy carrier, as well as to the quality of manufacturing of component parts and there is a large number of thin-walled fashioned component parts which negatively affects reliability of prior art air hammer apparatuses. This is the reason why the annular air hammer apparatuses have not come into a commercial use up to the present.

Known in the art is an annular air hammer apparatus for drilling wells (cf. USSR Inventor's Certificate No. 1133388, Int.Cl. E 21 C 3/24,1985), comprising a hollow cylindrical body in which an annular hammer is movably received and a stepped air distribution tube having inlet and exhaust ports is rigidly fixed, a pipe for receiving drillings and rock breaking tool movably mounted in the lower part of the body, having an axial passage for establishing communication of the interior space of the pipe for receiving drillings with the well bottom space, and blowing passages for supplying air to the pipe for receiving drillings. The air distribution tube cooperates with the hammer and defines therewith a work stroke chamber and defines a return stroke chamber with the body.

This design of the apparatus allows the impact power to be increased upon back pressure rise in the exhaust duct thereof which occurs when the pipe for receiving drillings is choked and also when the well comes deeper or water influx occurs. However, in the prior art apparatus, the main part of the exhaust air is admitted to the pipe for receiving drillings through the exhaust ports of the stepped air distribution tube which are spaced somewhat apart from the well bottom, and only a small fraction of air is fed to the well bottom through the blowing passages of the rock breaking tool. For that reason, the broken rock is slowly displaced through the pipe for receiving drillings up to the exhaust ports and only then will the velocity of its ascent increase under the action of the exhaust air flow. With such a system of air flow distribution, drillings plugs are very likely to form in the axial passage of the rock breaking tool and in the lower part of the pipe for receiving drillings. The broken rock coming at level with the exhaust ports may enter therethrough the working chamber of the impact mechanism to cause a rapid wear of friction surfaces and even jamming of the hammer. In addition, because of a change in air pressure in the exhaust duct which is caused by a change in its capacity, operation of the impact mechanism becomes unstable as regards both blow rate and impact energy. These factors, considered in combination, lower reliability of the prior art apparatus in operation.

It is an object of the invention to improve stability in operation and level of output parameters of the apparatus. Another object of the invention is to improve reliability of the apparatus in operation.

SUMMARY OF THE INVENTION

The above objects are accomplished by that in an annular air hammer apparatus for drilling wells, comprising a hollow cylindrical body accommodating a coaxially received stepped annular hammer mounted for reciprocations and a rigidly secured stepped air distribution tube having inlet ports in one step thereof and exhaust ports in the other step thereof, cooperating with the hammer and defining therewith a work stroke chamber and defining with the body a return stroke chamber, a pipe for receiving drillings, which is stationary mounted within the air distribution tube and defines therewith a plenum communicating with a compressed air line and alternately communicating, via the inlet ports of the air distribution tube, with the work stroke chamber and return stroke chamber, and a rock breaking tool movably mounted in the lower part of the body and having an axial passage for establishing communication of the interior space of the pipe for receiving drillings with a well bottom space and blowing passages for supplying air to the pipe for receiving drillings, according to the invention, an annular member is provided between the pipe for receiving drillings and air distribution tube in the zone between the inlet and exhaust ports to define with the outer periphery of the pipe for receiving drillings and the inner surface of the air distribution tube an exhaust chamber which communicates alternately, via the exhaust ports of the air distribution tube, with the work stroke chamber and return stroke chamber, and there is provided a throttle means through which the exhaust chamber permanently communicates with the plenum.

The provision of the exhaust chamber having a constant capacity allows stability of operation and average level of output parameters to be improved (blow rate and impact energy, impact power). Owing to the permanent communication of the exhaust chamber with the plenum through the throttle means of the annular member, a relatively constant air pressure is maintained in the exhaust chamber which is slightly higher than the pressure in the well bottom space and pipe for receiving drillings. This facility prevents broken rock from getting into the work stroke chamber and return stroke chamber through the exhaust ports of the air distribution tube whereby reliability of the apparatus in operation is improved.

The throttle means preferably comprises at least one orifice in the annular member.

This construction of the apparatus makes it possible to supply from the plenum to the exhaust chamber a strictly predetermined amount of air at minimum acceptable consumption of energy carrier by making an appropriate choice of an optimum cross-sectional area of the throttle means. In combination with a constant capacity of the exhaust chamber, this facility ensures a necessary increase in the pressure level that would block drillings from getting into the work stroke and return stroke chambers. Reliability of the apparatus is thus improved.

The annular member may be made in the form of a shoulder of the pipe for receiving drillings.

This arrangement of the apparatus simplifies its structure and, owing to a reduction of the number of interacting parts, improves reliability of the apparatus in operation.

The annular member may also be made in the form of an inner shoulder of the stepped air distribution tube.

This arrangement of the apparatus also improves reliability in operation because such a design precludes inadvertent increase in the cross-section of the throttle means establishing communication between the exhaust chamber and plenum which might take place upon a displacement of the annular member under the action of vibratory loads in elements of the structure.

The throttle means may be made in the form of an annular space defined betwen the shoulder of the pipe for receiving drillings and the inner surface of the stepped air distribution tube.

This arrangement of the apparatus provides for admission of air from the plenum uniformly along the perimeter of the exhaust chamber thereby lowering pressure pulsations in the exhaust chamber. This facility improves stability of the working cycle processes so that average level of output parameters and reliability of the apparatus in operation are improved.

The throttle means may be made in the form of an annular space defined between the inner shoulder of the stepped air distribution tube and the outer periphery of the pipe for receiving drillings.

This arrangement of the apparatus also ensures uniform admission of compressed air from the plenum to the exhaust chamber so as to lower pulsations of pressure in the exhaust chamber. This improves stability of operation, level of output parameters and reliability of the apparatus in operation.

It is preferred that the total cross-sectional area of the exhaust ports of the stepped air distribution tube and throttle means of the annular member should be equal to the total cross-sectional area of the blowing passages of the rock breaking tool.

This construction of the apparatus provides, with minor pulsations at the instant of exhaust, for a relatively constant air pressure in the exhaust chamber. This allows the most economical cycles to be realized so that the power of a compressed air source is utilized in the most efficient manner, and the apparatus works with almost constant blow rate and impact energy irrespective of the well depth.

BRIEF DESCRIPTION OF THE DRAWINGS

The invention will now be described in details with reference to specific embodiments thereof illustrated in the accompanying drawings, in which.

DETAILED DESCRIPTION OF THE INVENTION

Figure 1:
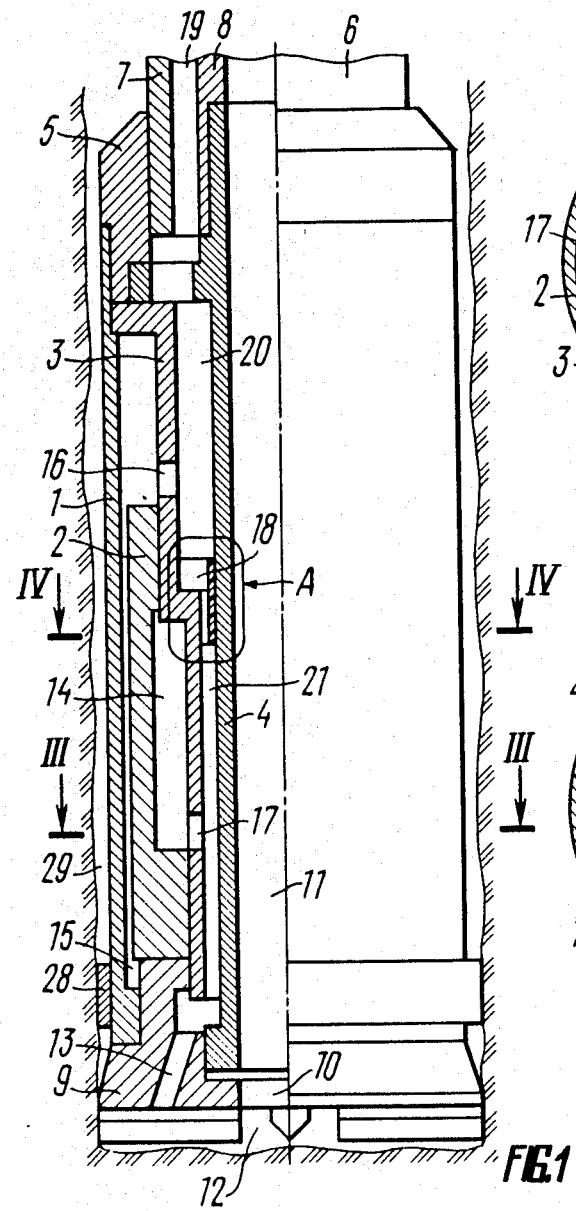
FIG. 1 schematically shows a longitudinal section view of an annular air hammer apparatus for drilling wells according to the invention at the moment a blow is delivered to a rock breaking tool.

An annular air hammer apparatus for drilling wells (FIGS. 1,2) comprises a hollow cylindrical body 1, a stepped annular hammer 2, a stepped air distribution tube 3, a pipe 4 for receiving drillings. The upper part of the body 1 is rigidly connected by means of an upper adapter 5 to a double drill pipe string 6 including an outer pipe 7 and an inner pipe 8 which is movably connected to the pipe 4 for receiving drillings. A rock breaking tool 9 is mounted for axial movement in the lower part of the body 1 and has an axial passage 10 for establishing communication between the interior space 11 of the pipe 4 for receiving drillings and a well bottom space 12. Blowing passages 13 are made in the rock breaking tool 9 for admitting exhaust air to the pipe 4 for receiving drillings.

The air distribution tube 3 defines with the hammer 2 a work stroke chamber 14 and defines with the body 1 a return stroke chamber 15. The air distribution tube 3 has inlet ports 16 and exhaust ports 17. An annular member 18 is provided between the pipe 4 for receiving drillings and air distribution tube 3 in the zone between the inlet ports 16 and exhaust ports 17 to divide the space between the walls of the air distribution tube 3 and pipe 4 for receiving drillings into a plenum 20 communicating with a compressed air line 19 and an exhaust chamber 21. The chambers 20 and 21 permanently communicate with each other through a throttle means of the annular member 18.

A packer 28 is provided in the body 1 to prevent compressed air and drillings from escaping from the well bottom space 12 into the annulus of a well 29.

The provision of the annular member 18 defining the exhaust chamber 21 aerodynamically connected with the plenum 20 through a throttle means between the pipe 4 for receiving drillings and air distribution tube 3 in the zone between the inlet ports 16 and exhaust ports 17 thereof allows stability of operation, level of output parameters and reliability of the apparatus in operation to be improved owing to the constant capacity of the exhaust chamber 21 and a relatively constant air pressure in the exhaust chamber irrespective of the well depth.

Figure 4:
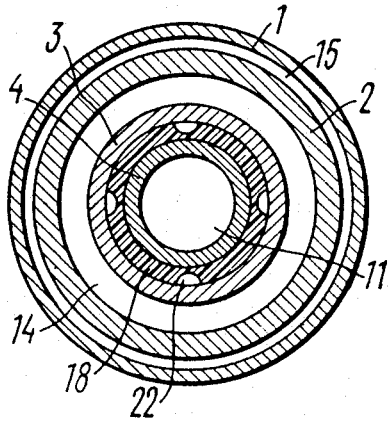
FIG. 4 shows a section on line IV—IV of FIG. 1.

In the embodiment of the apparatus shown in FIG. 4, the annular member 18 is provided between the pipe 4 for receiving drillings and air distribution tube 3 without any space therebetween and has a throttle means in the form of at least one orifice 22. Owing to a strictly predetermined value of its cross-sectional area a predetermined calculated amount of compressed air will be admitted from the plenum 20 to the exhaust chamber 21, whereby a relatively stable pressure level will be maintained in the exhaust chamber 21. This is especially important with minimum acceptable working pressure and energy carrier consumption, and ensures economical operation of the apparatus.

Figure 2:
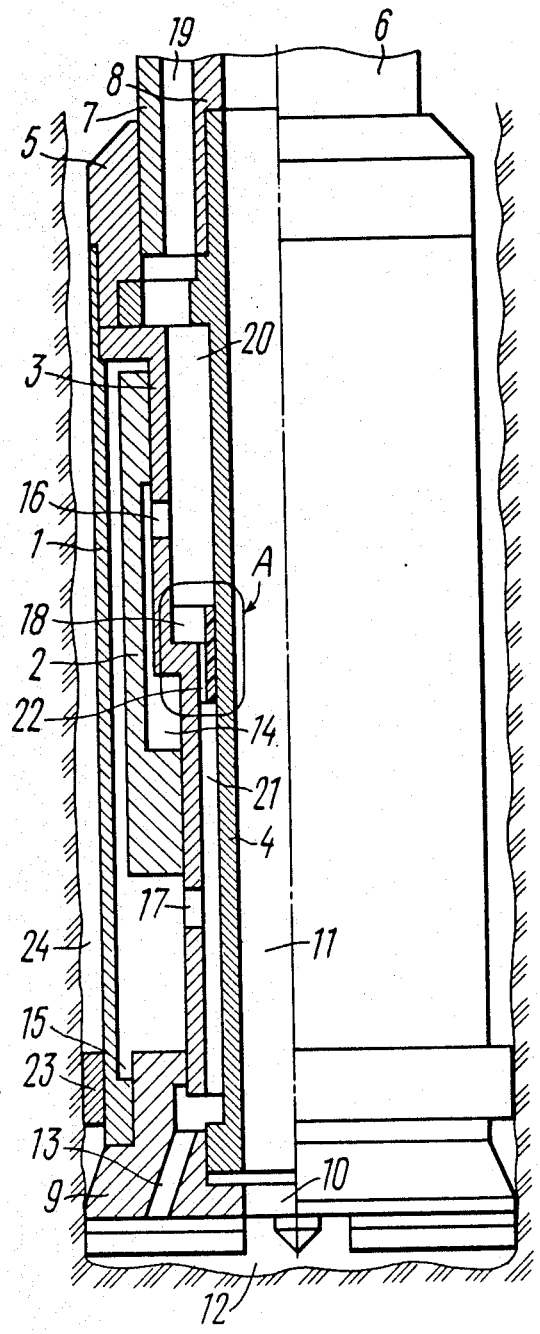
FIG. 2 schematically shows a longitudinal section view of an annular air hammer apparatus for drilling wells at the moment of the end of the return stroke of the hammer (to the upmost position)
Figure 5:
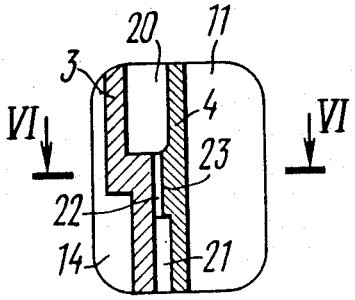
FIG. 5 is an embodiment of a detail A of the apparatus shown in FIG. 1, wherein the annular member is made in the form of a shoulder of a pipe for receiving drillings and has a throttle means in the form of an orifice.
Figure 6:
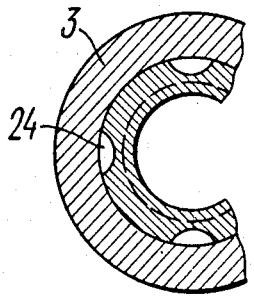
FIG. 6 shows a section on line VI—VI of FIG. 5.

In the embodiment of the apparatus shown in FIGS. 5,6 the annular member 18 comprises a shoulder 23 of the pipe 4 for receiving drillings, and the throttle means of the annular member 18 comprises at least one orifice 24 which has a function similar to that of the orifice 22 (FIG. 4). In this embodiment, owing to a smaller number of parts cooperating with one another (the annular member 18 of FIG. 1 is dispensed with as an individual part), the design of the apparatus is simplified. Reliability of the apparatus in operation is improved since the annular member 18, which is now integral with the pipe 4 for receiving drillings, is not susceptible to vibratory loads.

Figures 7, 9, 11:
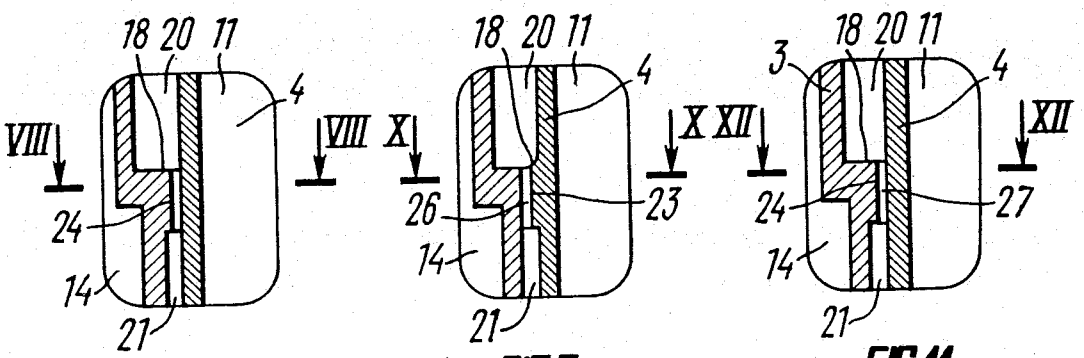
FIG. 7 is an embodiment of a detail A in FIG. 1, wherein the annular member is made in the form of an inner shoulder of a stepped air distribution tube.
FIG. 9 is an embodiment of a detail A in FIG. 1, wherein the annular member is made in the form of a shoulder of a pipe for receiving drillings with a throttle means in the form of an annular space.
FIG. 11 is an embodiment of a detail A in FIG. 1, wherein an annular member is made in the form of an inner shoulder of a stepped air distribution tube with a throttle means in the form of an annular space.
Figures 8, 10, 12:
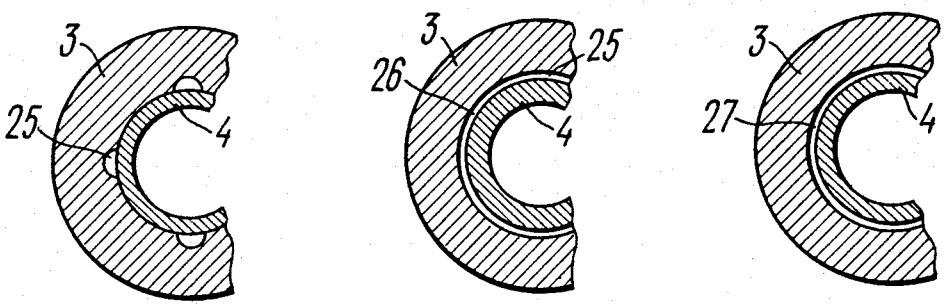
FIG. 8 shows a section on line VIII—VIII of FIG. 7.
FIG. 10 shows a section on line X—X of FIG. 9.
FIG. 12 shows a section on line XII—XII of FIG. 11.

In the embodiment of the apparatus shown in FIGS. 7 and 8, the annular member 18 comprises an inner shoulder 24 of the stepped air distribution tube 3, and the throttle means is provided in the annular member 18 in the form of at least one orifice 25 having a function which is similar to that of the orifice 24 (FIGS. 5, 6).

This embodiment of the apparatus is identical in terms of result to the embodiment shown in FIGS. 5,6.

In the embodiment of the apparatus shown in FIGS. 9 and 10, the pipe 4 for receiving drillings is provided with an annular member 18, and the throttling means establishing an aerodynamic connection between the plenum 20 and exhaust chamber 21 comprises an annular space 26 defined between the shoulder 23 of the pipe 4 for receiving drillings and inner surface of the stepped air distribution tube 3. In this embodiment compressed air is fed from the plenum through the annular space 26 into the exhaust chamber 21 so as to fill-up its volume in uniform manner. This facility smoothens pulsations of pressure in the exhaust chamber 21 at the moment of exhaust thereby improving stability of processes involved in the working cycle of the apparatus. In addition, the absence of mechanical contact between the stepped air distribution tube 3 and pipe 4 for receiving drillings that might be obtained through an annular member 18 in the form of an individual part, prevents vibratory loads from being transmitted so as to improve reliability of the apparatus in operation.

In the embodiment of the apparatus shown in FIGS. 11, 12, the throttling means comprises an annular space 27 defined between the inner shoulder 24 integral with the stepped air distribution tube 3 and outer periphery of the pipe 4 for receiving drillings. This embodiment of the apparatus is identical in terms of results to the embodiment shown in FIGS. 9 and 10.

The annular air hammer apparatus for drilling wells functions in the following manner (FIG. 1).

Figure 3:
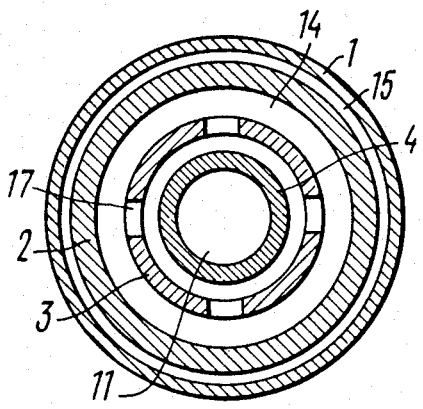
FIG. 3 shows a section on line III—III of FIG. 1.

Compressed air is admitted through the intertube space 19 of the double drill pipe string 6 to the plenum 20 and therefrom it is admitted through the inlet ports 16 of the stepped air distribution tube 3 to the return stroke chamber 15. In the position shown in FIGS. 1, 3 the work stroke chamber 14 communicates through the exhaust ports 17 with the exhaust chamber 21 in which pressure is lower than that in the plenum 20. Consequently, the hammer 2 starts performing its return stroke (to the upmost position in FIG. 1) under the action of a force equal to a product of the difference between pressures in the chambers 14 and 15 by the difference between surface areas of its upper and lower end faces. The hammer 2 covers the inlet ports 16 and exhaust ports 17 and will continue to move in the same direction until the work stroke chamber 14 starts communicating with the compressed air line 19 through the inlet ports 16 and plenum 20. At the same time, the return stroke chamber 15 starts communicating with the exhaust chamber 21 through the exhaust ports 17.

When the hammer 2 is in the upmost position (FIG. 2), compressed air is discharged from the return stroke chamber 15 through the exhaust ports 17, and pressure in the return stroke chamber 15 will decrease to the pressure value in the exhaust chamber 21. Concurrently with the abovedescribed events, compressed air from the air line 19 will start being admitted through the plenum 20 and inlet ports 16 to the work stroke chamber 14 so that pressure in this chamber will overcome pressure in the return stroke chamber 15. Under the action of pressure difference between chambers 14, 15 the hammer 2 will first stop and then start performing the work stroke (towards the lowermost position in FIG. 2) until it delivers a blow to the rock breaking tool 9.

During the movement of the hammer 2 downwards the inlet ports 16 and exhaust ports 17 are covered for a short time interval. The inlet ports 16 and exhaust ports 17 are uncovered before the hammer strikes at the rock breaking tool 9. Compressed air is discharged from the work stroke chamber 14 into the exhaust chamber 21 wherein this air is mixed with the air that passed through the throttle means from the plenum 20 (FIGS. 1,4). The mixed air flow will then move through the blowing passages 13 of the rock breaking tool 9 towards the bottom space 12 of the well. Broken rock is entrained with this flow and removed through the axial passage 10 of the rock breaking tool 9 into the interior space 11 of the pipe 4 for receiving drillings and then through the inner pipe 8 of the double drill pipe string 6 to the surface.

The packer 28 prevents air and drillings from escaping into the space 29 between the body 1 of the apparatus and the well walls.

Operation of the apparatus is various embodiments of structural arrangement of the annular member 18 and throttle means shown in FIGS. 5 and 6,7 and 8,9 and 10, 11 and 12 is similar to the operation of the embodiment shown in FIGS. 1,2,3,4. It should be noted that the embodiment shown in FIGS. s 9 and 10 is the most preferable one in view of simplicity of manufacture and improved reliability.

During operation of the annular air hammer apparatus an air pressure is maintained in the exhaust chamber 21 thereof which is higher than atmospheric pressure and lower than the line pressure. This is due to the fact that air is admitted to the chamber 21 concurrently through the exhaust ports 17 and through the throttle means. Air escape from the exhaust chamber 21 occurs through the blowing passages 13 of the rock breaking tool 9 into the bottom space 12 of the well and further into interior 11 of the pipe 4 for receiving drillings. The value of air pressure in the exhaust chamber 21 depends on the ratio between cross-sectional areas of the exhaust ports 17, throttle means and blowing passages 13 of the rock breaking tool 9.

For stable operation of the apparatus, it is necessary that the total cross-sectional area of the exhaust ports 17 and throttle means should be equal to the total cross-sectional area of the blowing passages 13 of the rock breaking tool 9. If the total cross-sectional area of the blowing passages 13 is smaller than the abovementioned total cross-sectional areas, the output parameters (blow rate and impact energy) of the air hammer apparatus will be lower as a result of a reduction of the exhaust duct. In addition, pulsations of air pressure in the exhaust chamber 21 will increase at the moment of escape of compressed air from the chambers 14 and 15 thus negatively affecting stability of operation of the apparatus.

If the total cross-sectional area of the blowing passages 13 is greater than the abovespecified value, air pressure in the exhaust chamber 21 will decrease to the extent depending on the value of difference between this cross-sectional area and the total cross-sectional area of the exhaust ports 17 and throttle means. With a large enough difference between the total cross-sectional areas air pressure in the exhaust chamber 21 will decrease up to atmospheric pressure. In this case the efficiency of the apparatus in operation also decreases.

In case of the equality of the total cross-sectional areas of the exhaust ports 17 and throttle means on the one hand and total cross-sectional area of the blowing passages 13 of the rock breaking tool 9 on the other hand, exhaust of compressed air from the return stroke chamber 15 and from the work chamber 14 occurs into the exhaust chamber 21 in which air pressure is maintained constant irrespective of the well depth (with minor pulsations when the hammer stroke is reversed). The parameters of the working cycle are chosen in such a manner that the design values of output parameters (blow rate, impact energy and impact power) should be achieved in operation with a predetermined differential air pressure between the plenum 20 and exhaust chamber 21.

In this case the air hammer apparatus will function with blow rate and impact energy which are almost constant irrespective of the well depth and exhaust pressure value in the well bottom zone at the base of the air and drillings column.

The use of this invention allows high stability of operation, improved output parameters and reliability of the apparatus in operation to be achieved.

What is claimed is:

1. An annular air hammer apparatus for drilling wells, comprising:

a cylindrical body;

a hammer received coaxially for reciprocations from a top position to a lower position in said body;

a stepped air distribution tube rigidly secured in said body and cooperating with said hammer;

a work stroke chamber defined between said air distribution tube and said hammer;

a return stroke chamber defined between said body and said air distribution tube;

a pipe for receiving drillings mounted in stationary disposition in said air distribution tube and having an interior space for the removal of drillings from the well bottom;

a plenum defined between said pipe and said air distribution tube;

a source of a gaseous fluid under pressure;

said plenum having an inlet establishing permanent communication between said plenum and said source of a gaseous fluid under pressure;

admission ports in the upper step of said air distribution tube for alternately communicating said plenum with said return stroke chamber when said hammer is in the lower position;

exhaust ports in the lower step of said air distribution tube;

a rock breaking tool mounted in the lower part of said body for axial movements;

an axial passage in said rock breaking tool, for providing communication between said pipe and the exterior of the hammer apparatus;

blowing passages in said rock breaking tool for feeding the gaseous fluid under pressure to said pipe for receiving drillings and for removing broken rock therethrough to the surface;

an annular member provided between said pipe for receiving drillings and said air distribution tube in the zone between said admission ports and said exhaust ports of the air distribution tube;

an exhaust chamber defined by said annular member between the outer surface of said pipe for receiving drillings and inner surface of said air distribution tube, the exhaust chamber alternately communicating through said exhaust ports of the air distribution tube with said work stroke chamber when the hammer is in the lower position and with said return stroke chamber when the hammer is in the upper position and;

a throttle means provided between said pipe for receiving drillings and said air distribution tube, the throttle means being located below the admission ports, said exhaust chamber permanently communicating with said plenum through the throttle means.

2. An apparatus according to claim 1, wherein the throttle means comprises at least one orifice in said annular member.

3. An apparatus according to claim 1, wherein said annular member comprises a shoulder on the outer periphery of said pipe for receiving drillings.

4. An apparatus according to claim 1, wherein said annular member comprises an inner shoulder of said stepped air distribution tube.

5. An apparatus according to claim 3, wherein said throttle means comprises an annular space defined between the shoulder of said pipe for receiving drillings and inner surface of said air distribution tube.

6. An apparatus according to claim 4, wherein said throttle means comprises an annular space defined between the inner shoulder of said air distribution tube and outer periphery of said pipe for receiving drillings.

7. An apparatus according to claim 1, wherein the total cross-sectional area of said exhaust ports of the air distribution tube and said throttle means is equal to the total cross-sectional area of said blowing passages of the rock breaking tool.

* * * * *